United States Patent [19]

Chiang

[11] Patent Number: 4,464,726

[45] Date of Patent: Aug. 7, 1984

[54] CHARGE DOMAIN PARALLEL PROCESSING NETWORK

[75] Inventor: Alice M. Chiang, Weston, Mass.

[73] Assignee: Massachusetts Institute of Technology, Cambridge, Mass.

[21] Appl. No.: 300,219

[22] Filed: Sep. 8, 1981

[51] Int. Cl.[3] ..... G06J 1/00; G06G 7/16

[52] U.S. Cl. ..... 364/606; 340/347 DA; 357/24; 364/844; 364/862; 377/63

[58] Field of Search ..... 364/602, 606, 844, 862, 364/841; 340/347 DA, 347 AD; 357/24; 377/57-63

[56] References Cited

U.S. PATENT DOCUMENTS

| | | | |
|---|---|---|---|
| 4,041,298 | 8/1977 | Lampe et al. | 364/862 |
| 4,063,200 | 12/1977 | Mattern | 364/862 X |
| 4,120,035 | 10/1978 | Cases et al. | 364/602 |
| 4,126,852 | 11/1978 | Baertsch | 364/606 X |
| 4,161,783 | 7/1979 | Wrench, Jr. et al. | 364/606 |
| 4,316,258 | 2/1982 | Berger | 364/825 X |

OTHER PUBLICATIONS

Jose F. Albarran and David A. Hodges, "A Charge--Transfer Multiplying Digital-to-Analog Converter", IEEE Journal of Solid-State Circuits, vol. SC-11, No. 6, Dec. 1976, pp. 772-779.

Carlo H. Sequin, Michael F. Tompsett, David A. Sealer & Ronald E. Crochiere, "A Symmetrically Balanced Linear Differential Charge-Splitting Input for Charge-Coupled Devices", IEEE Transactions on Electron Devices, vol. ED-24, No. 6, Jun. 1977, pp. 746-750.

Jerome Margolin & Paul C. McHugh, "Radar Signal Processing-Digital, Charge-Coupled Device (CCD), or Surface Acoustic Wave (SAW)?", SPIE, vol. 180, Real-Time Signal Processing II, (1979), pp. 230-241.

*Primary Examiner*—Joseph F. Ruggiero

*Attorney, Agent, or Firm*—Arthur A. Smith, Jr.; Thomas J. Engellenner

[57] ABSTRACT

A charge domain parallel processing network. The network includes a floating gate CCD tapped delay line and an array of CCD signal processors each including a charge domain digital-analog multiplier. The delay line holds and shifts analog sampled data in the form of charge packets. At each stage of the delay line a floating gate sensing electrode is coupled to an analog input of an associated one of the CCD signal processors. The sampled data in the respective delay line stages are transferred and subsequently processed in parallel in the processors. Within each processor, the computation functions are performed in the charge domain. In some forms, local charge domain accumulating memories accumulate and store the processed signals, for example, providing a matrix-matrix product network or providing a triple-matrix product network.

11 Claims, 14 Drawing Figures jth ACCUMULATING MEMORY (AFTER 1st PULSE RETURN)

| |
|---|
| $f_{ij}\ c_{K1}$ |
| ⋮ |
| $f_{ij}\ c_{21}$ |
| $f_{ij}\ c_{11}$ |

jth ACCUMULATING MEMORY (AFTER 2nd PULSE RETURN)

| |
|---|
| $f_{ij}\ c_{K1} + f_{2j}\ c_{K2}$ |
| ⋮ |
| $f_{ij}\ c_{21} + f_{2j}\ c_{22}$ |
| $f_{ij}\ c_{11} + f_{2j}\ c_{12}$ |

Fig.8 jth ACCUMULATING MEMORY (AFTER $n^{th}$ PULSE RETURN)

| |
|---|
| $\sum_{n=1}^{r} f_{nj}\ c_{Kn}$ |
| ⋮ |
| $\sum_{n=1}^{r} f_{nj}\ c_{2n}$ |
| $\sum_{n=1}^{r} f_{nj}\ c_{1n}$ |

Fig. 9 jth ACCUMULATING MEMORY (AFTER $N^{th}$ PULSE RETURN)

| |
|---|
| $\sum_{n=1}^{N} f_{nj}\ c_{Kn}$ |
| ⋮ |
| $\sum_{n=1}^{N} f_{nj}\ c_{2n}$ |
| $\sum_{n=1}^{N} f_{nj}\ c_{1n}$ |

Fig.10

$$h_{k\ell} = \sum_{j=1}^{J} \sum_{n=1}^{N} f_{nj} d_{nk} C_{j\ell}, \text{FOR } k=1,\ldots K, \; \ell=1,\ldots L$$

$$= \sum_{j=1}^{J} g_{kj} C_{j\ell}$$

$$h_{k\ell} = \sum_{j=1}^{J} \sum_{n=1}^{N} f_{nj} d_{nk} C_{j\ell}, \text{FOR } k=1,\ldots K \quad \ell=1,\ldots L$$

$$= \sum_{j=1}^{J} g_{kj} C_{j\ell}$$

$$h_{k\ell} = \sum_{j=1}^{J} \sum_{n=1}^{N} f_{nj} d_{nk} C_{j\ell}, \text{FOR } k=1,\ldots K, \; \ell=1,\ldots L$$

$$= \sum_{j=1}^{J} g_{kj} C_{j\ell}$$

CHARGE DOMAIN PARALLEL PROCESSING NETWORK

The Government has rights in this invention pursuant to Contract Number AF19(628)-80-C-0002 awarded by the U.S. Department of the Air Force.

REFERENCE TO RELATED APPLICATION

The subject matter of this application is related to that of commonly assigned U.S. patent application Ser. No. 294,633, entitled "Charge Domain Digital-Analog Multiplier", A. M. Chiang and B. E. Burke, filed on Aug. 20, 1981. That application is incorporated by reference herein.

BACKGROUND OF THE INVENTION

The present invention is in the field of integrated circuit networks and more particularly is directed to charge domain parallel processing networks.

In the prior art, multiplier circuits have generally been provided by signal transformations in the current domain, i.e. by controlling sums of weighted current signals.

In one form, multiplying digital-to-analog converter devices have been produced using bucket brigade devices (BBD's). These converter devices generally utilize a set of binary-weighted capacitors which have an analog signal impressed across them. MOS transistors drive currents into and out of selected ones of the set of capacitors. The particular ones of the set of capacitors which are so driven is controlled by gates which are controlled by a digital word signal (which may be user controlled for a variable multiplier, or may be preset for a fixed weight multiplier). The charging or discharging currents for the capacitors are summed and serve to launch a charge packet in a BBD. While that resultant charge packet in the BBD is proportional to the product of a digital word (which controls the gates to the respective capacitors) and an analog voltage applied to those capacitors, the generation of this charge packet is relatively slow, principally due to the long time constant associated with the MOS transistors used in the charging of the capacitors.

It is an object of the present invention to provide a charge domain parallel processing network.

It is another object to provide a charge domain vector-matrix product network.

Yet another object is to provide a charge domain matrix-matrix product network.

Still another object is to provide a charge domain triple matrix product device.

SUMMARY OF THE INVENTION

Briefly, the present invention includes a floating-gate CCD tapped delay line for holding and shifting analog sampled-data in the form of charge packets, and an array (or a matrix) of CCD digital-analog multipliers. At each stage of the delay line there is a floating-gate sensing electrode. The output of the sensing electrode is coupled to the analog input port of a corresponding CCD digital-analog multiplier. The output of each multiplier is a charge packet which is proportional to the product of the analog sampled data and a digital word.

This structure can be used to form networks adapted for performing high level mathematical operations such as vector-matrix product, i.e., $$\sum_{n=1}^{N} f_n c_{nk} = g_k$$

for k=1, 2 . . . K; matrix-matrix product, i.e., $$\sum_{n=1}^{N} f_{nj} c_{nk} = g_{jk}$$

for k=1, 2 . . . K, and j=1, 2, . . . J; and triple matrix product, i.e., $$\sum_{j=1}^{J} \sum_{n=1}^{N} f_{nj} c_{kn} d_{jl} = h_{kl}$$

for k=1, 2 . . . K, and l=1, 2, . . . L, where $f_n$'s and $f_{nj}$'s are analog sampled data, $c_{kn}$'s and $d_{jl}$'s are digital numbers, and J, K, L, N are positive integers which represent the dimension of the corresponding vector or matrix.

The vector-matrix product network may be configured to perform functions such as discrete Fourier transforms (DFT). In alternate configurations, the network may eliminate scanning ground clutter from an aircraft surveillance radar by performing as an optimal moving target indicator (MTI) filter bank. In yet other configurations, the network may function as a matched filter bank for applications such as the Global Positioning System (GPS).

The matrix-matrix product network may be configured to perform N-point doppler processing for J range cells in the range window of a pulsed radar system. The triple matrix product network may be configured to perform two dimensional image transforms and image reconstruction for video bandwidth reduction in digital picture processing systems. Examples of such systems might include nationwide computer and time sharing networks for teleconferenced image sharing, medical consultation, multispectral satellite images, spacecraft probes, remote piloted vehicles, facsimile transmission of images ranging from fingerprints to text, and even image transmissions over existing telephone networks.

BRIEF DESCRIPTION OF THE DRAWINGS

The foregoing and other objects of this invention, the various features thereof, as well as the invention itself, may be more fully understood from the following description, when read together with the accompanying drawings in which:

FIGS. 8–10 illustrate the operation of the accumulating memory of the network of FIG. 6;

DESCRIPTION OF THE PREFERRED EMBODIMENT

Two preferred forms of the charge domain analog-digital multiplying devices used in the present invention are described here. The first is a "fixed-weight" digital-analog multiplier where the digital word is predetermined (for example, at the mask-making stage). In this form, analog sampled-data is always multiplied by the same digital word, and the output of the fixed-weight multiplier is a charge packet which is always proportional to the analog input by the same factor. No digital input is needed for a fixed-weight multiplier (i.e., it only has one analog input and one analog output).

The second form of the charge domain analog-digital multiplying device is a multiplying, digital-to-analog converter (MDAC). Each MDAC with M-bit accuracy has one analog input, M-parallel digital inputs, and one analog output. The digital word for the MDAC is electrically programmable (for example, by the user). The output of the MDAC is a charge packet which is proportional to the product of the analog input and the digital word.

Exemplary fixed-weight multipliers and an exemplary MDAC's are described in detail in the incorporated reference.

Figure 1:
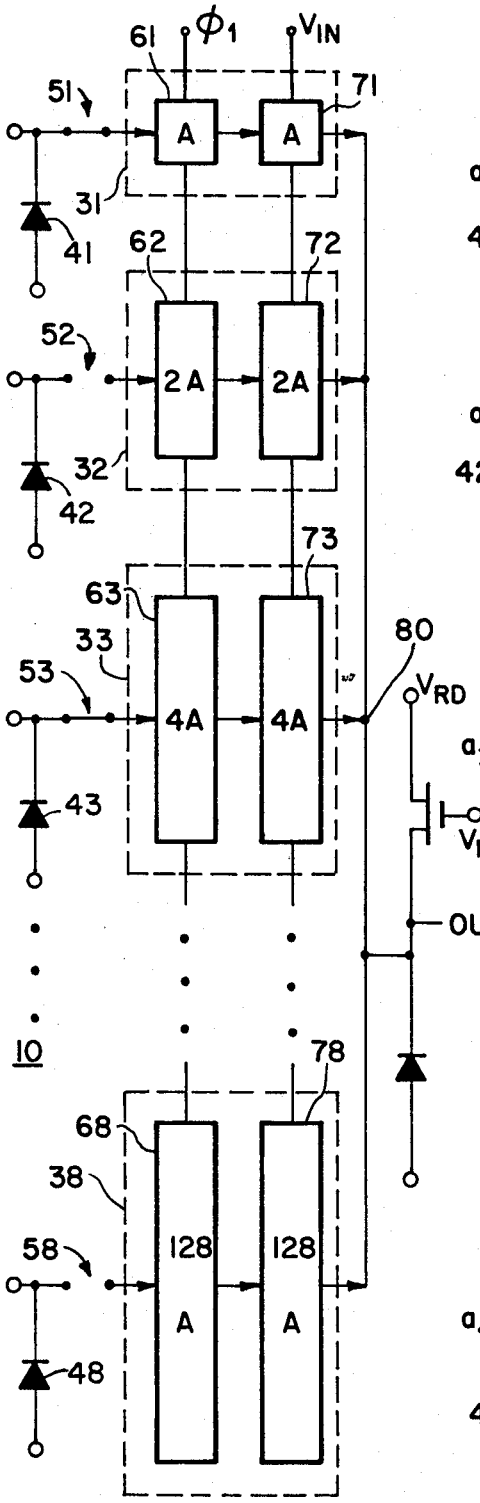
FIGS. 1 and 2 show in schematic form, exemplary fixed weight and programmable weight charge domain analog-digital multipliers, respectively.

FIG. 1 in this application shows an 8-bit CCD fixed-weight digital-analog multiplier 10. That multiplier 10 includes eight CCD cells 31–38, each cell underlying an associated one of reference potential electrodes 61–68 and an associated one of weighting electrodes 71–78. Input charge injection networks 41–48 are hard-wired by way of mask-programmed switch connections 51–58 to inject (or not) charge packets into associated ones of the cells 31–38. Each of the cells is coupled to a summing node 80 so that the charge packets in cells 31–38 may be transferred and summed at that node. The charge packet at node 80 has a magnitude proportional to the weighted (by the area of electrodes 71–78) product of the analog voltage on electrodes 71–78 and the digital word represented by the states of switches 51–58.

Figure 2:
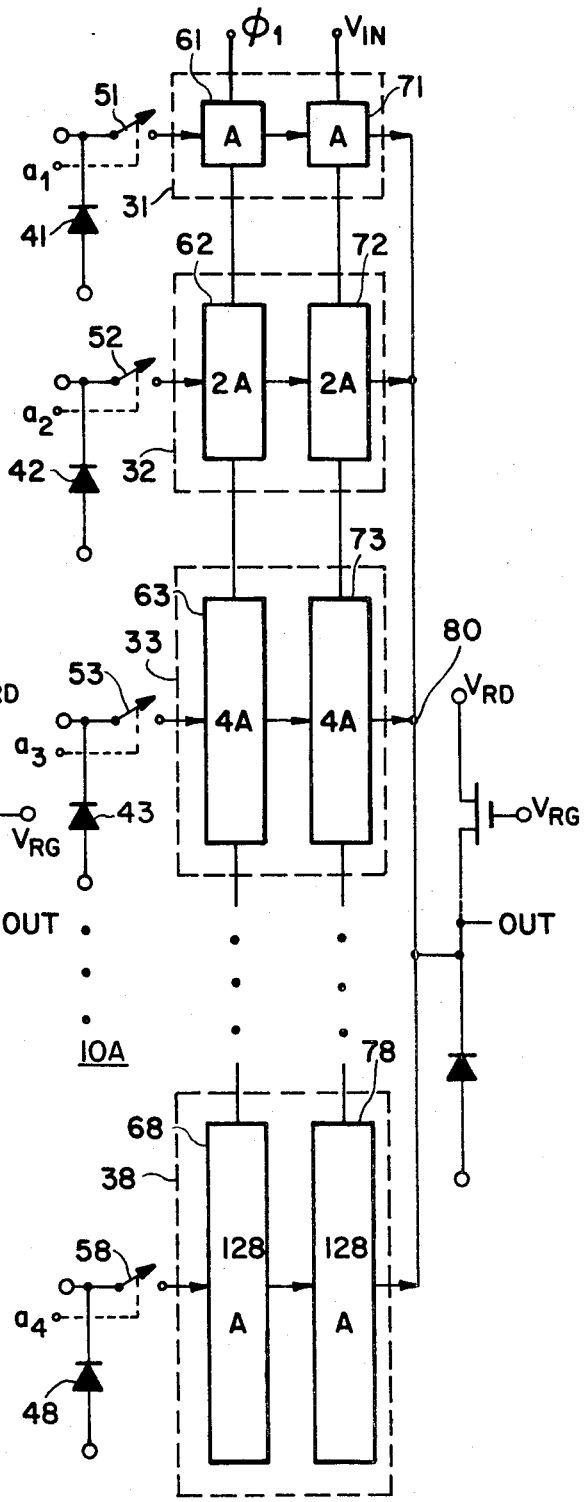

FIG. 2 shows an 8-bit CCD multiplying digital-to-analog converter (MDAC) 10A. The MDAC 10A is substantially similar to multiplier 10 except that the hard-wired connections 51A–53A are replaced by switches 51–58 which are controllable in response to the logic levels of the respective bits of an applied digital word signal $a_1a_2a_3 \ldots a_8$. When one of these gates 51–58 is in its conductive state, a charge packet may be injected into its associated CCD cell. When one of gates 51–58 is in its non-conductive state, no charge packet may be injected into its associated cell. Thus, the logic levels (represented by signals $a_1, a_2, \ldots a_8$ in FIG. 2) control the potential of the input diodes and thereby perform a multiplication of the charge flow to the input gates by 0 or 1.

The charge domain digital analog multipliers of FIGS. 1 and 2 of the present application are similar to that shown in FIG. 8 of the incorporated reference, except that the embodiments in the Figures of the present application do not include the floating diffusion output circuitry and output source follower.

CHARGE DOMAIN PARALLEL PROCESSING DEVICE

Figure 3:
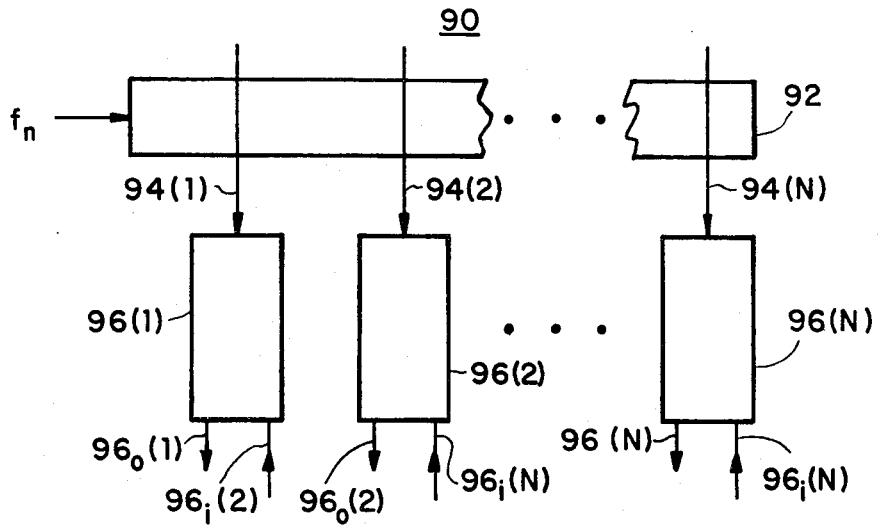
FIG. 3 shows in schematic form a charge domain parallel processing network in accordance with the present invention.

FIG. 3 shows a charge domain parallel processing device 90 in accordance with the present invention. Device 90 includes an N-stage CCD tapped delay line 92, in which each stage underlies an associated one of floating gate sensing electrodes 94(1) through 94(N). Each of these electrodes is coupled to the analog input of an associated one of digital-analog multipliers 96(1) through 96(N). The digital inputs (denoted by $96_i(1)$ through $96_i(N)$ to the multpliers may be fixed, for fixed weight multipliers, such as that shown in FIG. 1. Alternatively, these inputs may be variable, for variable weight multipliers (or MDAC's), such as that shown in FIG. 2. The output from each multiplier (denoted by arrows $96_o(1)$ through $96_o(N)$ is a charge packet which is proportional to the product of the analog potential at the analog input gate (from the floating gate sensing electrode) and the digital signal at the digital input.

VECTOR-MATRIX PRODUCT DEVICE

The present invention may be configured to perform the vector-matrix product function:

$$[g_1\, g_2 \cdots g_K] = [f_1\, f_2 \cdots f_N] \cdot \begin{bmatrix} c_{11} & c_{12} & \cdots & c_{1K} \\ c_{21} & c_{22} & \cdots & c_{2K} \\ \cdot & \cdot & \cdot & \cdot \\ \cdot & \cdot & \cdot & \cdot \\ \cdot & \cdot & \cdot & \cdot \\ \cdot & \cdot & \cdot & \cdot \\ c_{N1} & c_{N2} & \cdots & c_{NK} \end{bmatrix}$$

$$\text{or } g_k = \sum_{n=1}^{N} f_n c_{nk} \qquad \text{for } k = 1, 2, \ldots K.$$

Figure 4:
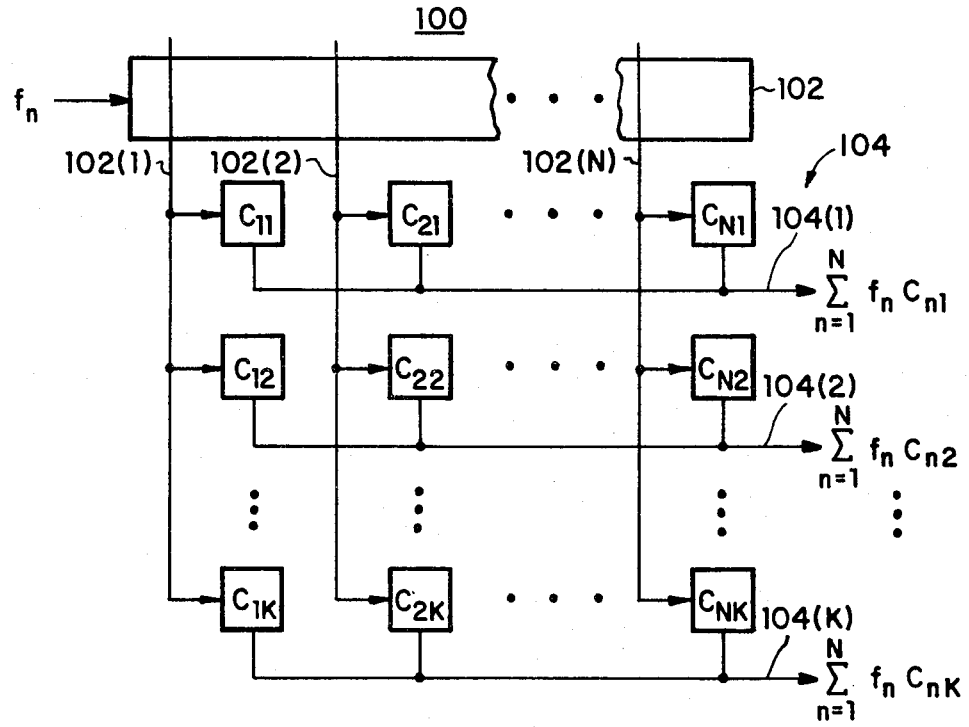
FIGS. 4 and 5 show in schematic form exemplary vector-matrix product networks in accordance with the present invention.

FIG.4 shows a device 100 in which this vector matrix product operation may be performed in which the matrix [C] is predetermined at the mask-making stage. The device 100 includes an N-point, floating-gate, tapped delay line 102 (having floating gate sensing electrodes 102(1) through 102(N) positioned along the delay line), and an N-by-K array of fixed-weight digital-analog multipliers (denoted $C_{11}$ through $C_{NK}$), for example having the form of FIG. 1. All the multipliers on the same column have a common analog input which is coupled to the sensing electrode of the corresponding floating gate tap. All the multipliers on the same row have a common output node, where this node functions as a device for summing the charge packets applied thereto by the multipliers.

The device 100 operates as follows. N analog samples of data, $f_n$, for $n=1, 2, \ldots N$, are sequentially loaded into the CCD delay line 102 using conventional techniques for establishing and shifting charge packets in CCD's. When the N charge packets have been established in delay line 102, the summed output at the first row of multipliers (at line 104(1)) is $$\sum_{n=1}^{N} f_n c_{n1}$$

which is equal to $g_l$. In general, the summed output at the kth row is $$\sum_{n=1}^{N} f_n c_{nk},$$

which is equal to $g_k$. Therefore, the output at each row of the multiplier bank represents one element of the vector G, which is to be computed by this device 100.

In this device 100, the analog data can be continuously loaded into the CCD delay line 102. For example, after the second sampling period, the analog sampled data in the CCD delay lines are $f_{N+1}, f_N, \ldots f_3, f_2$. The corresponding output at the first row of the multiplier bank is $$\sum_{n=2}^{N+1} f_n c_{n1}.$$

Similarly, the output at the kth row is $$\sum_{n=2}^{N+1} f_n c_{nk}.$$

In general, after P sampling periods, the output at the kth row is $$\sum_{n=P}^{N+P-1} f_n c_{nk}.$$

Figure 5:
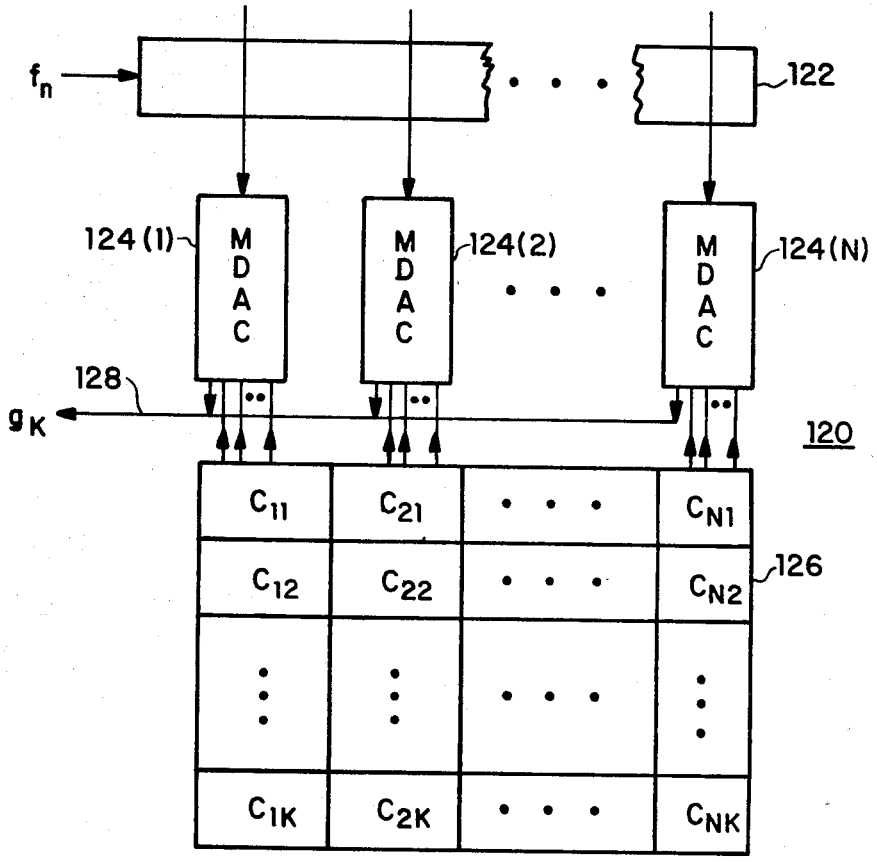

FIG. 5 shows a device 120 which also performs the vector-matrix product function, i.e., $$\sum_{n=1}^{N} f_n c_{nk} = g_k$$

for $k=1, 2 \ldots K$, where $f_n$ is an analog sampled function and each element in the matrix [C] is an M-bit digital word. In ths form, the matrix [C] is electrically programmable by the user.

The device 120 includes an N-point, floating gate, tapped delay line 122, N multiplying D-to-A converters (MDAC's) with M-bit accuracy (denoted 124(1) through 124(N)) and an N×K×M-bit, parallel-addressible, digital memory 126. The digital memory can be either on-chip or off-chip. By way of example, CCD or ROM memories can be used in either volatile or non-volatile form. The floating-gate tap outputs coupled to the analog inputs of the corresponding MDAC's. The digital inputs of the MDAC's are controlled by the M bit words in the respective cells of the digital memory 126. All the MDAC's have a common output 128.

In operation, after the analog vector function $f_n$'s are serially loaded into the CCD tapped delay line 122, the CCD clock is stopped. The floating-gate output after each stage of delay is coupled to the analog input of the corresponding MDAC. The digital memory is parallel addressible, i.e., it can be simultaneously accessed in serial to all the columns. After time $T_c$, the memory output is the first row of the matrix C (i.e., $c_{11}, c_{21}, \ldots c_{N1}$), and each element is an M-bit word. These digital words are applied to the digital input port of the corresponding MDAC. The summed output from all the MDAC's is $$\sum_{n=1}^{N} f_n c_{n1}$$

which is equal to $g_1$. The second row of the digital memory, (i.e., $c_{12}, c_{22}, \ldots c_{N2}$) is now shifted out and the summed output from all N the MDAC's is $$\sum_{n=1}^{N} f_n c_{n2} = g_2.$$

In general, after the kth row of the digital memory is applied to the MDAC's, the summed output from all the MDAC's is $$\sum_{n=1}^{N} f_n c_{nk} = g_k.$$

In summary, as the digital memory 126 is sequentially addressed row-by-row, there are a sequence of analog output data from the MDAC's summing mode. They are $$\sum_{n=1}^{N} f_n c_{n1}, \sum_{n=1}^{N} f_n c_{n2}, \ldots \sum_{n=1}^{N} f_n c_{nk}$$

which are $g_1, g_2, \ldots g_k$, respectively. Therefore, the device computes the desired vector-matrix product [F][C].

Thus, the analog function $f_n$ is serially loaded into the CCD delay line. The analog sampled data is updated by one clock period, i.e. so that the stored data in the delay line are now, $f_{N+1}, f_N, \ldots f_3, f_2$. The same multiplication process is repeated (i.e., address the digital memory K times and perform K sequential multiplication). As a result, there are a sequence of output data on the MDAC's summing mode 128 which are representative of $$\sum_{n=2}^{N+1} f_n c_{n1}, \sum_{n=2}^{N+1} f_n c_{n2}, \ldots \sum_{n=2}^{N+1} f_n c_{nK}.$$

A GENERAL PURPOSE MATRIX-MATRIX PRODUCT DEVICE

Figure 6:
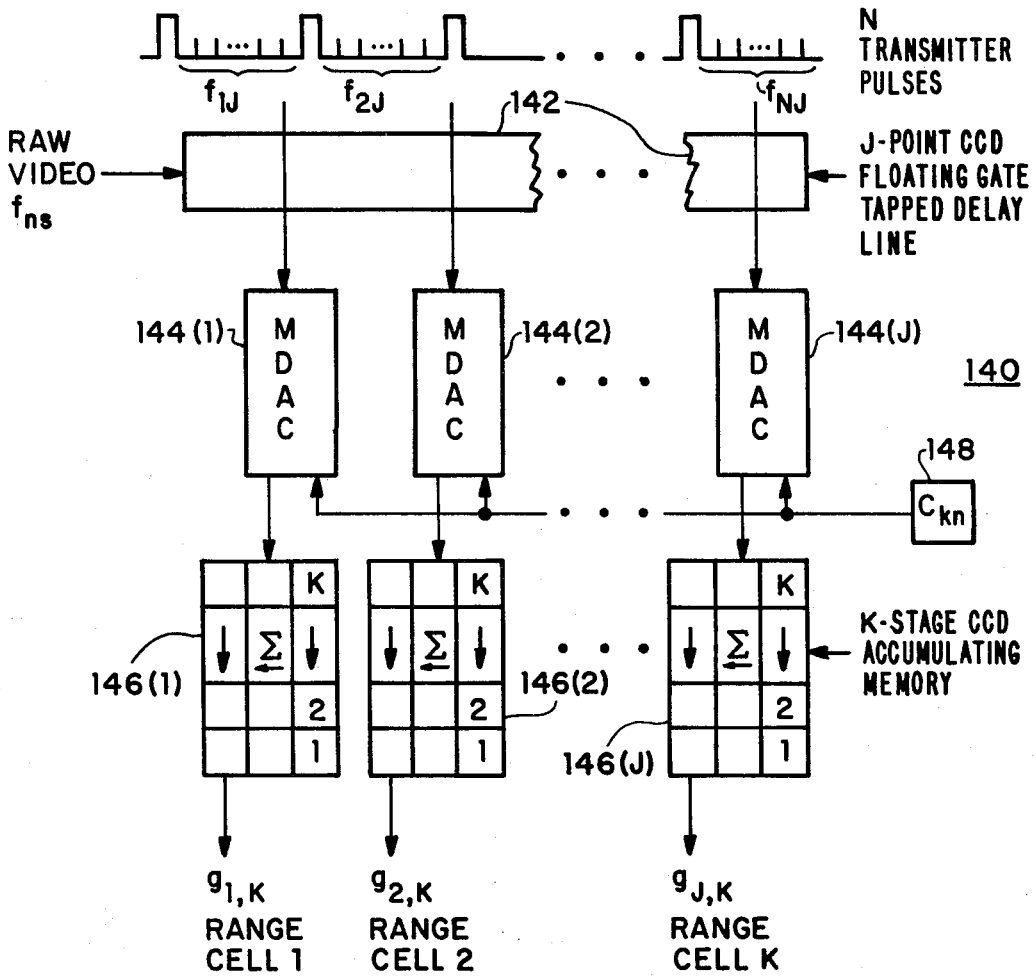
FIGS. 6 and 7 show in schematic form an exemplary matrix-matrix product network in accordance with the present invention.

FIG. 6 shows processing network 140 for computing the function:

$$g_{kj} = \sum_{n=1}^{N} c_{kn} f_{nj} \text{ for } \begin{cases} j = 1, 2, \ldots J \\ k = 1, 2, \ldots K \end{cases}$$

or $$\begin{bmatrix} g_{11} & g_{12} & \cdots & g_{1J} \\ g_{21} & g_{22} & \cdots & g_{2J} \\ \cdot & \cdot & \cdot & \\ \cdot & \cdot & \cdot & \\ g_{K1} & g_{K2} & \cdots & g_{KJ} \end{bmatrix} = \begin{bmatrix} c_{11} & c_{12} & \cdots & c_{1N} \\ c_{21} & c_{22} & \cdots & c_{2N} \\ \cdot & \cdot & \cdot & \\ \cdot & \cdot & \cdot & \\ c_{K1} & c_{K2} & \cdots & c_{KN} \end{bmatrix} \begin{bmatrix} f_{11} & f_{12} & \cdots & f_{1J} \\ f_{21} & f_{22} & \cdots & f_{2J} \\ \cdot & \cdot & \cdot & \\ \cdot & \cdot & \cdot & \\ f_{N1} & f_{N2} & \cdots & f_{NJ} \end{bmatrix}$$

Figure 7:
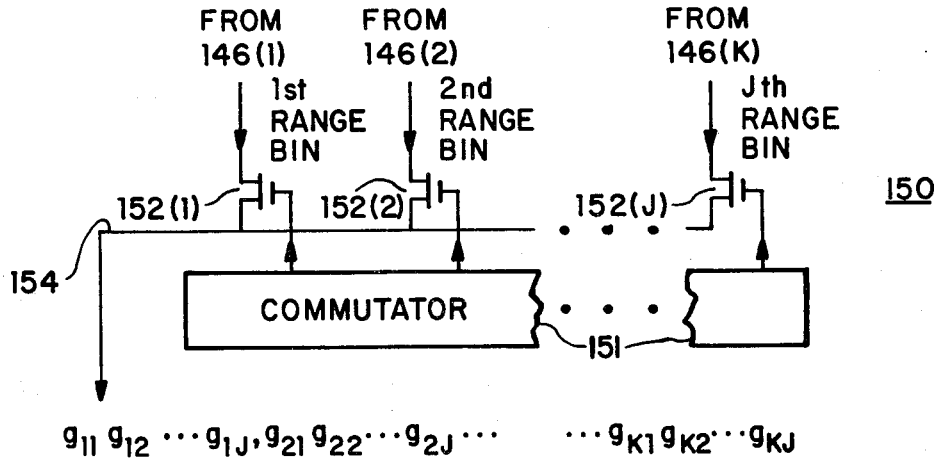

FIG. 7 shows a processing network 150 adapted to be coupled to the network 140. By way of example, this device 140 is suitable to perform the N-point Fourier transform of J range cells in the range window of a pulsed radar system.

Device 140 includes a J-point, floating-gate, tapped delay line 142; J M-bit, MDAC's denoted 144(1) through 144(J); J K-stage, CCD accumulating memories each with separate input and output shift registers (denoted 146(1) through 146(J)); and an N×K M-bit word digital memory 148. The N×K word digital memory 148 is serially accessible column-by-column. The digital memory 148 can be either on-chip or off-chip. All the MDAC's have common digital inputs, but the output of each MDAC goes to a corresponding one of the accumulating memories 146(1) through 146(J).

Each accumulating memory is a CCD device including a 3-column-by-K-row array of cells. Conventionally configured electrodes overlay the respective cells so that a sequence of charge packets may be serially loaded (by driving circuits, not shown) into the righthand (as shown in FIG. 6) column of cells. Following that loading, the driving circuits may transfer the loaded charge packets in parallel to adjacent cells in the center column. This operation may be repeated so that each cell of that center column accumulates a charge packet which is a composite of the successive packets transferred to that cell. Thereafter, the charge packets from the central column may be transferred in parallel to the lefthand column of cells, and then read out in serial form. Each of these charge transfer operations is performed using conventional electrode configurations and driving techniques.

In operation of device 140, after the first row of analog sampled data, $f_{11}, f_{12}, \ldots f_{1J}$, is serially loaded into the tapped delay line 142, the CCD clock is stopped. The signal charge in each sensing well is used to control the analog input of the corresponding MDAC's. The first column of the digital memory, $c_{11}, c_{21}, \ldots c_{K1}$, is then sequentially applied to the common digital input ports of all the MDAC's. It will be understood that there are M bits for each digital word applied in parallel to each MDAC. The outputs from the first MDAC are 144(1) sequentially $$f_{11}\,c_{11}, f_{11}\,c_{21}, \ldots, f_{11}\,c_{K1}.$$

In general, the outputs from the jth MDAC 144(J) are $$f_{1j}\,c_{11}, f_{1j}\,c_{21}, \ldots, f_{1j}\,c_{K1}.$$

The string of output data from each MDAC is serially loaded into the corresponding one of CCD accumulating memories 146(1) through 146(J). After the whole string of data is loaded in the memory, the data set is parallel transferred to the storage well of the memory. The second row of the analog sampled data, $f_{21}, f_{22}, \ldots, f_{2J}$ is then loaded into the CCD tapped delay line. The same process is repeated, but this time the second column of the digital memory, $c_{12}, c_{22}, \ldots c_{K2}$ is sequentially applied to the common input ports of all the MDAC's. Thus, at the output of the jth MDAC, there is a sequence of output data, $f_{2j}\,c_{12}, f_{2j}\,c_{22}, \ldots, f_{2j}\,c_{K2}$. After this string of data is serially loaded into the jth accumulating memory, it is parallel transferred to the storage wells. After this operation, the information stored in the jth accumulating memory is as shown in FIG. 8.

In general, after each new row of analog sampled data is loaded into the tapped delay line, the same multiplication process is repeated. Each data point is then simultaneously multiplied by a sequence of digital words, $c_{1n}, c_{2n}, \ldots, c_{Kn}$. The sequence of output data from each MDAC $f_{nj}\,C_{1n}, f_{nj}\,C_{2n}, \ldots, f_{nj}\,C_{Kn}$ is serially loaded into the corresponding accumulating memory and parallel transferred to the storage well. At the $r^{th}$ time, the information stored in the jth accumulating memory is as shown in FIG. 9. After the Nth (or the last) row of the analog sampled data is processed by the same procedure described above, the information stored in the jth accumulating memory is as shown in FIG. 10. This data sequence is equal to the jth column elements of the [G] matrix,.which is to be computed by device 140. Therefore, the stored data sequence $g_{1j}, g_{2j}, \ldots, g_{Kj}$ may now be parallel transferred to the output shift register and serially clocked out. In other words, the serial output from each accumulating memory are the corresponding column elements of the [G] matrix. Thus, the device 140 computes the matrix-matrix product, [F][C], providing the matrix-matrix product column elements in parallel from memories 146(1) through 146(J).

FIG. 7 shows a processing network 150 for coupling to the memories 146(1) through 146(J) to provide a serial output of these matrix-matrix product element signals. Network 150 includes a commutator 151 and FET gates 152(1) through 152(J). These elements act in concert to serially provide the coefficient output signals on line 154. This configuration is particularly useful for a pulsed Doppler radar system having J range bias. In this configuration, the commutator and gate arrangement may be replaced with a parallel-in, serial out CCD shift register.

GENERAL PURPOSE TRIPLE MATRIX PRODUCT DEVICE

The present invention may be adapted for performing the function of $$[H]=[D]\,[F]\,[C]$$

where $$[F]=\begin{bmatrix} f_{11} & f_{12} & \cdots & f_{1J} \\ f_{21} & f_{22} & \cdots & f_{2J} \\ \vdots & \vdots & & \vdots \\ F_{N1} & f_{N2} & \cdots & f_{NJ} \end{bmatrix}$$

and $f_{nj}$'s are analog sampled data;

$$[D]=\begin{bmatrix} d_{11} & d_{12} & \cdots & d_{1N} \\ d_{21} & d_{22} & \cdots & d_{2N} \\ \vdots & \vdots & & \vdots \\ d_{K1} & d_{K2} & \cdots & d_{KN} \end{bmatrix} \quad [C]=\begin{bmatrix} c_{11} & c_{12} & \cdots & c_{1L} \\ c_{21} & c_{22} & \cdots & c_{2L} \\ \vdots & \vdots & & \vdots \\ c_{J1} & c_{J2} & \cdots & c_{JL} \end{bmatrix}$$

and $d_{nk}$, $c_j$ are digital numbers.

$$[H]=\begin{bmatrix} h_{11} & h_{12} & \cdots & h_{1L} \\ h_{21} & h_{22} & \cdots & h_{2L} \\ \vdots & \vdots & & \vdots \\ h_{K1} & h_{K2} & \cdots & h_{KL} \end{bmatrix}$$

where $h_{kl}$'s are the desired final product. In this example, the columns of the matrix [F] are to be multipled by the matrix [D], and the rows of the matrix [F] are to be multiplied by the matrix [C]. In terms of image processing applications, the columns of the two dimensional image [F] are to be transformed by the [D] wave functions and the rows of the image [F] are to be transformed by the [C] wave functions.

Equation 1 can be rewritten as $$h_{kl} = \sum_{j=1}^{J} \sum_{n=1}^{N} f_{nj} d_{kn} c_{jl} \text{ for} \begin{cases} k = 1, 1, \ldots, K \\ l = 1, 2, \ldots, L \end{cases}$$

[G] is defined as $$[G] = [D][F] = \begin{bmatrix} g_{11} & g_{12} & \cdots & g_{1J} \\ g_{21} & g_{22} & \cdots & g_{2J} \\ \cdot & \cdot & & \cdot \\ \cdot & \cdot & \cdots & \cdot \\ \cdot & \cdot & & \cdot \\ g_{K1} & g_{K2} & \cdots & f_{KJ} \end{bmatrix}$$

$$\text{or } g_{kj} = \sum_{n=1}^{N} f_{nj} d_{kn}$$

As a result, $$[H]=[G][C].$$

or $$h_{kl} = \sum_{j=1}^{J} g_{kj} c_{jl}.$$

The matrix [G] can be obtained by the matrix-matrix product device described above in conjunction with FIGS. 7–10. There are two preferred ways to calculate the second matrix-matrix product. In the first, the matrix [C] is predetermined at the mask-making stage.

Figure 11:
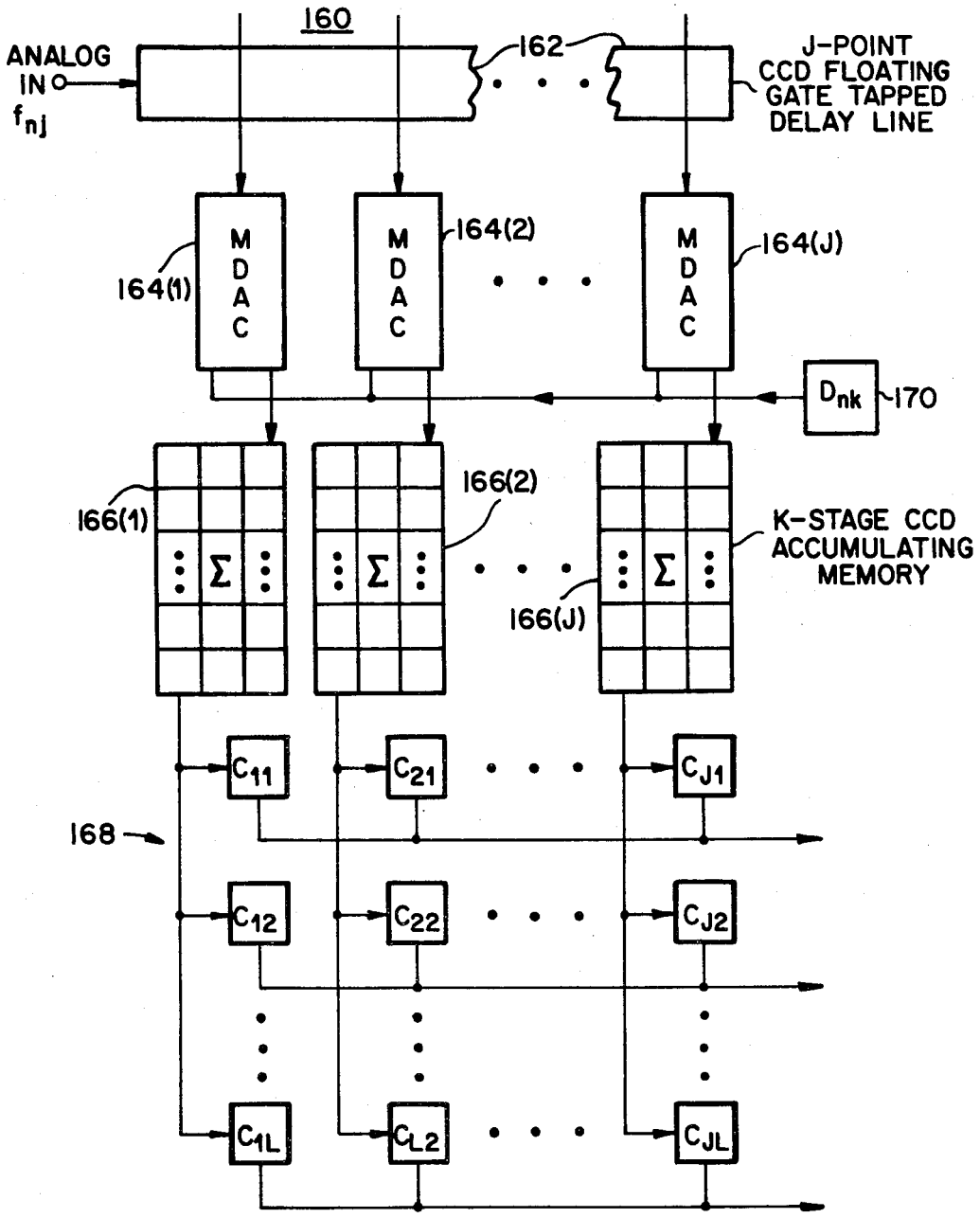
FIG. 11 shows in schematic form an exemplary triple matrix product device in accordance with the present invention.

FIG. 11 shows a mask programmable two-dimensional matrix transformer device 160. The device calculates the triple matrix product:

$$h_{kl} = \sum_{j=1}^{J} \sum_{n=1}^{N} f_{nj} d_{kn} c_{jl}$$

where $f_{nj}$ are analog sampled data.

$d_{kn}$ are digital numbers with M-bit accuracy;

$c_{jl}$ are digital numbers with M-bit accuracy which are predetermined at the mask-making stage.

The device 160 consists of a J-stage, floating-gate, tapped CCD delay line 162; J MDAC's with M-bit accuracy denoted 164(1) through 164(J); J K-stage, CCD accumulating memories with separate input and output serial shift registers (denoted 166(1) through 166(J)); an L-by-K fixed-weight CCD multiplier bank 168; and an N-by-K M-bit word digital memory 170. The digital memory 170 is serially accessible column by column. It can be either on-chip or off-chip. The floating-gate tap outputs of line 162 are coupled to the analog inputs of the corresponding MDAC's. All the MDAC's have common digital inputs which are controlled by the digital memory 170. The output from each MDAC serially loaded into its associated accumulating memory. All the fixed-weight multipliers on the same column have a common analog input (i.e., the output from the jth accumulating memory is coupled to the inputs of the jth column of the fixed weight multipliers). All the multipliers on the same row have a common output node.

The device operates as follows. Two consecutive matrix-matrix product steps are used to calculate the triple matrix product. The CCD delay line 162, MDAC's and accumulating memories are used to compute the first matrix-matrix product (i.e., the G matrix). Uhen the input matrix F is loaded into the device row-by-row the calculated G matrix is parallel accessible row by row or all the columns can be simultaneously serial accessed. Consequently, a second fixed-weight vector-matrix product device can be used to complete the 2-D matrix transform. The procedure of calculating the [G] matrix is the same as described above in conjunction with FIGS. 7–10.

Figure 12:
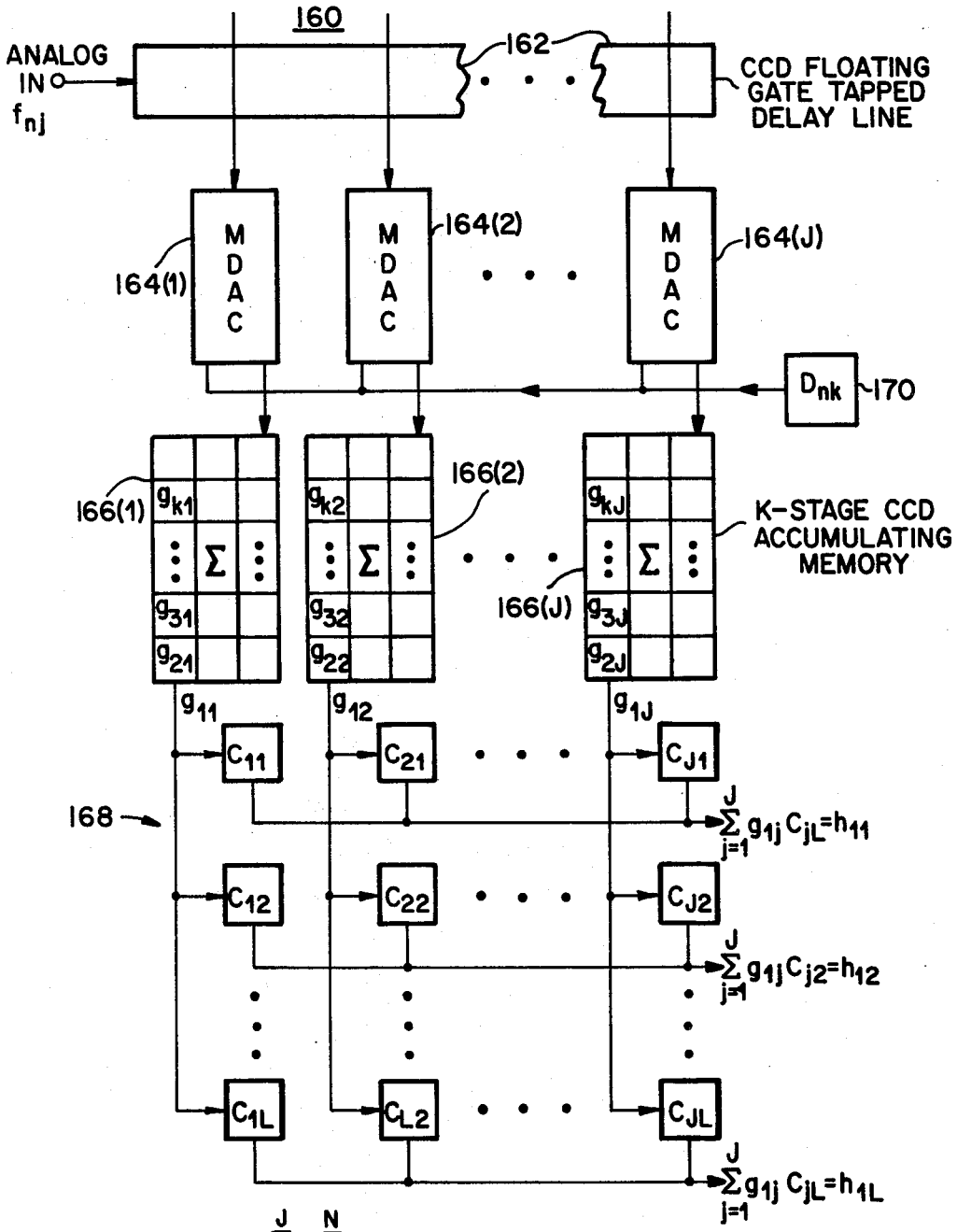
FIGS. 12 and 13 illustrate the operation of the network of FIG. 11.

All the fixed-weight multipliers on the same column have a common analog input which is controlled by the output of the associated accumulating memory. All the multipliers on the same row have a common output node. As described previously, the sequential output from the 1st accumulating memory is $g_{11}, g_{21}, \ldots, g_{K1}$, (i.e., the 1st column element of G matrix). In general, the sequential output from the jth accumulating memory is $g_{1j}, g_{2j}, \ldots, g_{Kj}$. When the first row of the [G] matrix has been clocked out from the J accumulating memories, as shown in FIG. 12, $g_{11}$ is applied to the first column of the L×J multiplier banks and $g_{12}$ to the 2nd column and $g_{1j}$ to the jth column. Since all the multipliers on the same row have the common output mode, the total signal charge transferred to the summing node of the 1st row of the multiplier is proportional to $$\sum_{j=1}^{J} g_{1j} c_{j1} = h_{11}.$$

The output charge at the 2nd row of the multiplier is $$\sum_{j=1}^{J} g_{1j} c_{j2} = h_{12}.$$

Figure 13:
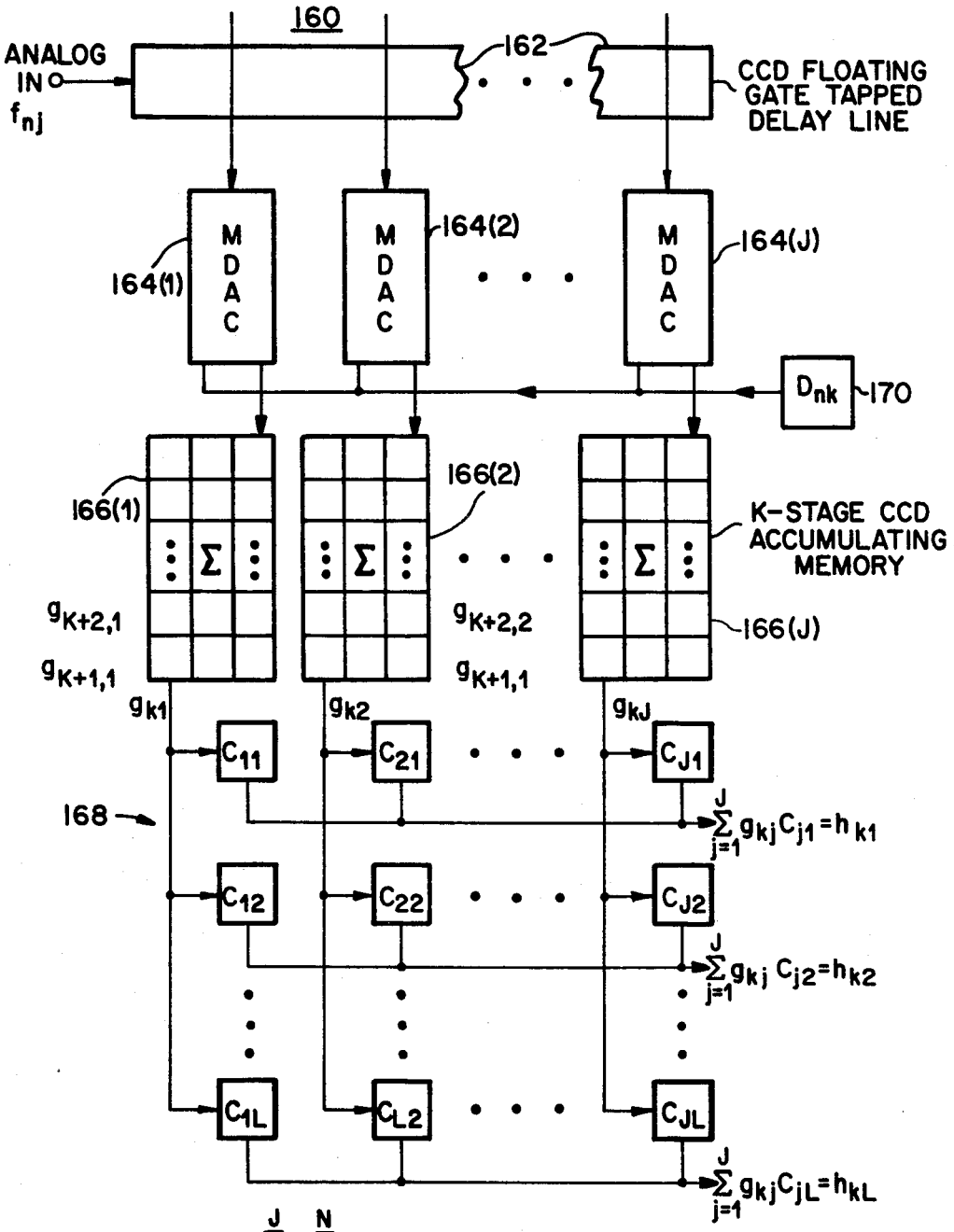

Consequently, after the 1st row of elements of the [G] matrix is clocked out from the J accumulating memories, there is one summed output for each row of the multiplier bank. These L parallel output data correspond to the first row of the [H] matrix (i.e., $h_{11}, h_{12}, \ldots, h_{1L}$). After the 2nd row of the [G] matrix is clocked out from the accumulating memory, the fixed-weight multiplier bank calculates the 2nd row element of H, (i.e., $h_{21}, h_{22}, \ldots, h_{2L}$). Finally, after the last row of the [G] matrix has been clocked out from the accumulating memory, the multiplier banks compute the last row element of H. The corresponding output sequence of the H matrix is shown in FIGS. 11, 12 and 13. Thus, the device 160 computes the triple matrix product $[H]=[D][F][C]$.

Figure 14:
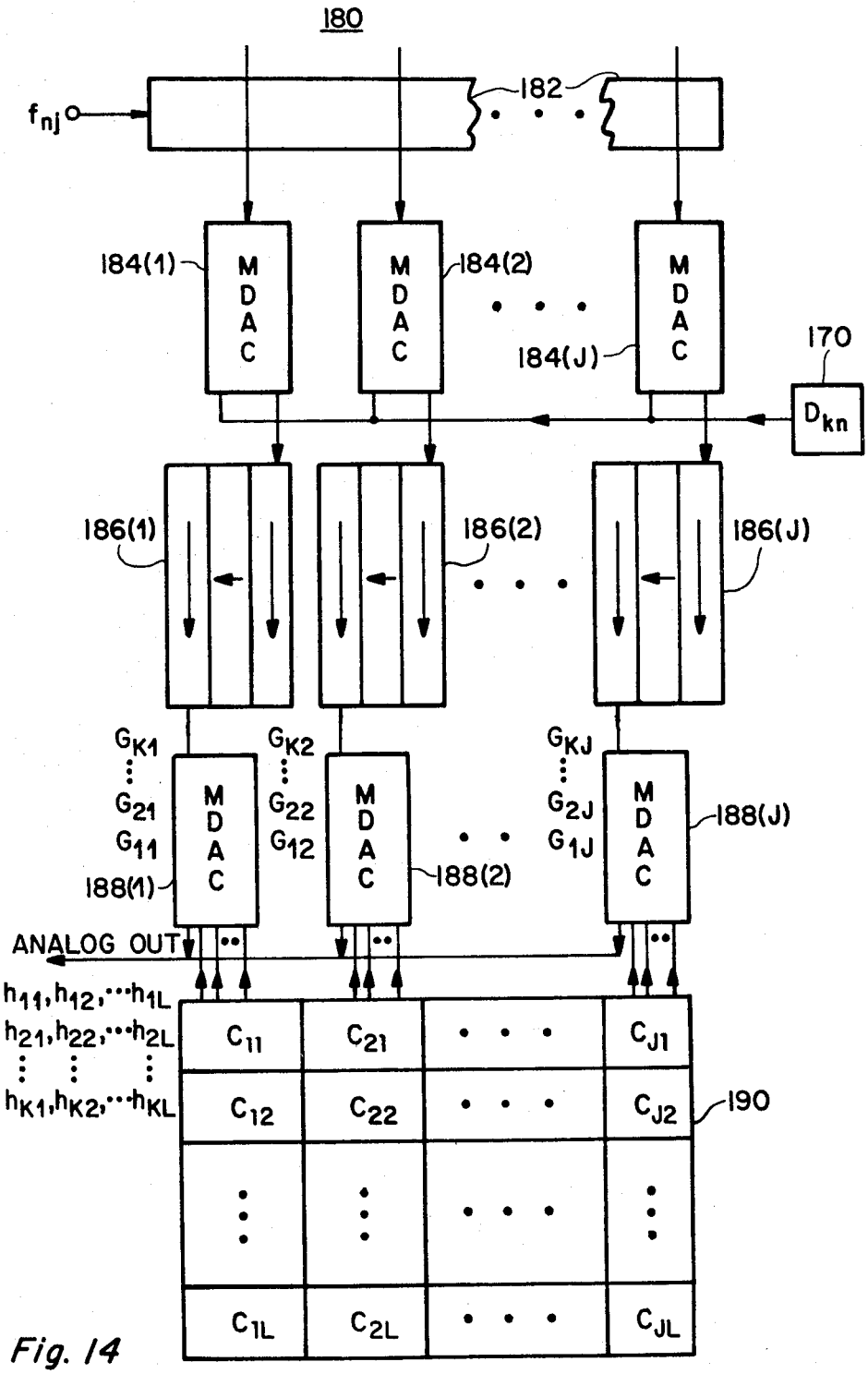
FIG. 14 shows in schematic form another exemplary embodiment of a triple matrix product device in accordance with the present invention.

FIG. 14 shows an electrically programmable triple matrix product device 180. The device 180 is adapted for computing the triple matrix product $$h_k = \sum_{j=1}^{J} \sum_{n=1}^{N} f_{nj} d_{kn} c_{jl} \text{ for} \begin{cases} k = 1, 2, \ldots, K \\ l = 1, 2, \ldots, L \end{cases}$$

where $f_{nj}$ are analog sampled data, $d_{nk}$ and $c_j$ are digital numbers with M-bit accuracy and both matrices [C] and [D] are programmable by the user.

In this device 180, two consecutive matrix-matrix product steps are used to perform the triple matrix product. In FIG. 14, the delay line 182, the MDAC's (denoted 184(1) through 184(J)) and the accumulating memories (denoted 186(1) through 186(J)) are the same as those shown in FIG. 11. Consequently, this part of the device 180 calculates the [F] and [D] matrix products, i.e., the [G] matrix. The only difference from the device described in the previous section is that, in this device 180, the output of each accumulator is coupled to the analog input of an associated or of MDAC 188(1) through 188(J). The digital inputs of the 2nd row of the MDAC's are controlled by an on-chip, parallel, accessible digital memory 190.

The operation of the device can be described by two steps. The first step calculates the matrix [G] which is the same as described in conjunction with FIG. 12, the second step (i.e., computing the [G][C] product) readdresses the digital memory C, for computing each row element of [H] which is parallel accessible or simultaneously serially accessible to each column. Therefore, after the 1st row of this matrix $G_1$ (i.e., $g_{11}, g_{12}, \ldots, g_{1J}$) are shifted out from the accumulating memories, the digital memory is parallel addresed row by row L times and L sequential multiplications are performed at each MDAC. It will be understood that all the MDAC's have a common output node. The sequence of output data from the summing nodes of the MDAC's is $$\sum_{j=1}^{J} g_{1j} c_{j1} = h_{11}, \sum_{j=1}^{J} g_{1j} c_{j2} = h_{12}, \ldots, \sum_{j=1}^{J} g_{1j} c_{jL} = h_{1L}$$

which are the 1st row elements of the [H] matrix. After the kth row of the [G] matrix is shifted out from the accumulating memories and coupled to the corresponding MDAC's, the sequence of output data from the MDAC's summing nodes are $$\sum_{j=1}^{J} g_{kj} c_{j1}, \sum_{j=1}^{J} g_{kj} c_{j2}, \ldots, \sum_{j=1}^{J} g_{kj} c_{jL}$$

which are equal to $h_{k1}, h_{k2}, \ldots, h_{kL}$ (i.e., the kth row of the matrix [H]). Finally, after the last row of the [G] matrix is shifted out from the accumulating memories, the sequence of output data at the MDAC's summing node is $$\sum_{j=1}^{J} g_{kj} c_{j1}, \sum_{j=1}^{J} g_{kj} c_{j2}, \ldots, \sum_{j=1}^{J} g_{kj} c_{jL}$$

which are the last row element of the matrix [H] to be calculated by the present device.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A charge domain parallel processing network, comprising:

A. a charge coupled device (CCD) comprisng a single multi-stage tapped delay line including means for establishing a succession of charge packets therein in response to a succession of applied input signals, means for shifting said charge packets from stage-to-stage along said delay line, and a plurality of floating gate sensing electrodes, each of said electrodes overlying one of said stages and being adapted to provide a potential thereon representative of the magnitude of a charge packet currently within its underlying stage, B. a plurality of charge domain digital-analog multipliers, each of said multipliers including means for generating a charge packet therein having a magnitude proportional to the product of a potential applied to an analog input port and a digital signal, and C. means for coupling said sensing electrodes to the analog input ports of associated ones of said digital-analog multipliers.

2. A network according to claim 1 wherein said multipliers each include a digital input port adapted to receive said digital signal.

3. A network according to claim 1 wherein said multipliers each include means for generating said digital signal, said digital signal representing a predetermined value.

4. A charge domain vector-matrix product network for generating the signals representative of the product of an N-element vector and an N×K element matrix, comprising:

A. a charge coupled device (CCD) N-stage tapped delay line, including means for establishing a succession of N charge packets therein in response to a succession of N applied input signals, each of said packets having a magnitude corresponding to one of the elements of said vector, means for shifting said charge packets from stage-to-stage along said delay line, and N floating gate sensing electrodes, each of said electrodes overlying one of said stages and being adapted to provide a potential thereon representative of the magnitude of a charge packet currently within its underlying stage, B. an N×K array of fixed weight charge domain digital-analog multipliers, each of said multipliers including means for generating a charge packet therein having a magnitude proportional to the product of a potential applied to an analog input port and a digital weight associated therewith, wherein the digital weight associated with each multiplier in said array is proportional to the value of the correspondingly positioned element of said matrix, and wherein the input ports of the multipliers of each column of said N×K array are coupled to an associated sensing electrode of said delay line, and C. K charge summing devices, each of said summing devices including means for generating an output charge packet having a magnitude proportional to the sum of the magnitudes of the charge packets generated by the multipliers in an associated row of said array, wherein the magnitude of said output charge packets correspond to the respective elements of said vector-matrix product.

5. A charge domain vector-matrix product network for generating the signals representative of the product of an N-element vector and an N×K element matrix, comprising:

A. a charge coupled device (CCD) N-stage tapped delay line, including means for establishing a succession of N charge packets therein in response to a succession of N applied input signals, each of said packets having a magnitude corresponding to one of the elements of said vector, means for shifting said charge packets from stage-to-stage along said delay line, and N floating gate sensing electrodes, each of said electrodes overlying one of said stages and being adapted to provide a potential thereon representative of the magnitude of a charge packet currently within its underlying stage, B. an N×K×M bit memory device adapted for storing N×K M-bit words, each of said words being representative of the value of a corresponding element of said matrix, C. N M-bit charge domain digital-analog multipliers, each of said multipliers including means for a charge packet thereon having a magnitude proportional to the product of a potential applied to an analog input port and a digital signal applied to a digital input port, wherein the analog input port of each of said multipliers is coupled to an associated sensing electrode of said delay line, and D. a controller for successively applying N words of said memory device at a time to the respective digital input ports of said multipliers, where each set of N words includes the words representative of the values of one of the rows of said matrix, E. a charge summing device operative for each set of N words, including means for generating an output charge packet having a magnitude proportional to the sum of the magnitudes of the charge packets generated by said multipliers, wherein the magnitude of said output charge packets correspond to the respective elements of said vector-matrix product.

6. A charge domain matrix-matrix product network for generating signals representative of the product of an N×K element matrix and an N×J element matrix, comprising:

A. a charge coupled device (CCD) J-stage tapped delay line, including means for establishing N successions of J charge packets therein in response to N successions of J applied input signals, each of said packets having a magnitude corresponding to successive ones of the elements of said N×J element matrix, means for shifting said charge packets from stage-to-stage along said delay line, and J floating gate sensing electrodes, each of said electrodes overlying one of said stages and being adapted to provide a potential thereon representative of the magnitude of a charge packet currently within its underlying stage, B. an N×K×M bit memory device adapted for storing N×K M-bit words, each of said words being representative of the value of a corresponding element of said matrix, C. J M-bit charge domain digital-analog multipliers, each of said multipliers including means for a charge packet thereon having a magnitude proportional to the product of a potential applied to an analog input port and a digital signal applied to a digital input port, wherein the analog input port of each of said multipliers is coupled to an associated sensing electrode of said delay line, D. a controller for successively applying ones of the N×K words of said N×K×M bit memory device to the digital input ports of each of said multipliers, E. J CCD K-bit accumulating memory devices, each of said accumulating memory devices having a serial input port coupled to receive the N successions of K charge packets generated by an associated one of said multipliers, wherein the output charge packets of said accumulating memory devices correspond to the respective elements of said matrix-matrix product.

7. A network according to claim 6 wherein said accumulating memory devices include an array of CCD cells, said array including at least three columns of K cells and A. means selectively operative to shift one of said successions of K charge packets in series into the respective cells of that column to load that column, B. means selectively operative following the loading of said first column to transfer charge packets in parallel from the cells of said first column to corresponding cells in a second column, said cells of said second column including means for accumulating successively transferred charge packets, C. means selectively operative following N transfers of charge packets from cells of said first column to cells of said second column, to transfer said accumulated charge packets in parallel from the cells of said second column to corresponding cells of a third column, D. means selectively operative following the transfer of said accumulated charge packets from said second column to said third column, to transfer said accumulated charge packets in serial from the cells of said third column, said serially transferred accumulated charge packets corresponding to said output charge packets.

8. A charge domain triple matrix product network for generating signals representative of the product of an N×K element matrix, an N×J element matrix and a J×L element matrix, comprising:

A. a charge coupled device (CCD) J-stage tapped delay line, including means for establishing N successions of J charge packets therein in response to N successions of J applied input signals, each of said packets having a magnitude corresponding to successive ones of the elements of said N×J element matrix, means for shifting said charge packets from stage-to-stage along said delay line, and J floating gate sensing electrodes, each of said electrodes overlying one of said stages and being adapted to provide a potential thereon representative of the magnitude of a charge packet currently within its underlying stage, B. an N×K×M bit memory device adapted for storing N×K M-bit words, each of said words being representative of the value of a corresponding element of said matrix, C. J M-bit charge domain digital-analog multipliers, each of said multipliers including means for a charge packet thereon having a magnitude proportional to the product of a potential applied to an analog input port and a digital signal applied to a digital input port, wherein the analog input port of each of said multipliers is coupled to an associated sensing electrode of said delay line, D. a controller for successively applying ones of the N×K words of said N×K×M bit memory device to the digital input ports of each of said multipliers, E. J CCD K-bit accumulating memory devices, each of said accumulating memory devices having a serial input port coupled to receive the N successions of K charge packets generated by an associated one of said multipliers, F. an L×J array of fixed weight charge domain digital-analog multipliers, each of said multipliers including means for generating a charge packet therein having a magnitude proportional to the product of a potential applied to an analog input port and a digital weight associated therewith, wherein the digital weight associated with each multiplier in said array is proportional to the value of the correspondingly positioned element in said L×J element matrix, and wherein the analog input ports of the multipliers of each column of said L×J array are coupled to the output port of an associated one of said accumulating memories, and G. J charge summing devices, each of said summing devices including means for generating an output charge packet having a magnitude proportional to the sum of the magnitude of the charge packets generated by the multipliers in an associated row of said L×J array, wherein the magnitude of said output charge packets correspond to the respective elements of said triple matrix product.

9. A network according to claim 8 wherein said accumulating memory devices include an array of CCD cells, said array including at least three columns of K cells and A. means selectively operative to shift one of said successions of K charge packets in series into the respective cells of that column to load that column, B. means selectively operative following the loading of said first column to transfer charge packets in parallel from the cells of said first column to corresponding cells in a second column, said cells of said second column including means for accumulating successively transferred charge packets, C. means selectively operative following N transfers of charge packets from cells of said first column to cells of said second column, to transfer said accumulated charge packets in parallel from the cells of said second column to corresponding cells of a third column, D. means selectively operative following the transfer of said accumulated charge packets from said second column to said third column, to transfer said accumulated charge packets in serial from the cells of said third column, said serially transferred accumulated charge packets corresponding to said output charge packets.

10. A charge domain triple matrix product network for generating signals representative of the product of an N×K element matrix, an N×J element matrix and a J×L element matrix, comprising:

A. a charge coupled device (CCD) J-stage tapped delay line, including means for establishing N successions of J charge packets therein in response to N successions of J applied input signals, each of said packets having a magnitude corresponding to successive ones of the elements of said N×J element matrix, means for shifting said charge packets from stage-to-stage along said delay line, and J floating gate sensing electrodes, each of said electrodes overlying one of said stages and being adapted to provide a potential thereon representative of the magnitude of a charge packet currently within its underlying stage, B. an N×K×M bit memory device adapted for storing N×K M-bit words, each of said words being representative of the value of a corresponding element of said matrix, C. J M-bit charge domain digital-analog multipliers, each of said multipliers including means for a charge packet thereon having a magnitude proportional to the product of a potential applied to an analog input port and a digital signal applied to a digital input port, wherein the analog input port of each of said multipliers is coupled to an associated sensing electrode of said delay line, D. a controller means for successively applying ones of the N×K words of said N×K×M bit memory device to the digital input ports of each of said multipliers, E. J CCD K-bit accumulating memory devices, each of said accumulating memory devices having a serial input port coupled to receive the N successions of K charge packets generated by an associated one of said multipliers, F. an L×J×M bit memory device adapted for storing L×J M-bit words, each of said words being representative of the value of a corresponding element of said L×J element matrix, G. J M-bit charge domain digital-analog multipliers, each of said multipliers including means for a charge packet thereon having a magnitude proportional to the product of a potential applied to an analog input port and a digital signal applied to a digital input port, wherein the analog input port of each of said multipliers is coupled to the output port of an associated one of said accumulating memory devices, H. a controller means for successively applying one set of J words of said L×J×M bit memory device at a time to the set of digital input ports of said J multipliers, where each set of J words includes words representative of the values of the elements in one of the rows of said L×J matrix, I. a charge summing device operative for each set of J words, including means for generating an output charge packet having a magnitude proportional to the sum of the magnitudes of the charge packets generated by said J multipliers.

11. A network according to claim 10 wherein said accumulating memory devices include an array of CCD cells, said array including at least three columns of K cells and A. means selectively operative to shift one of said successions of K charge packets in series into the respective cells of that column to load that column, B. means selectively operative following the loading of said first column to transfer charge packets in parallel from the cells of said first column to corresponding cells in a second column, said cells of said second column including means for accumulating successively transferred charge packets, C. means selectively operative following N transfers of charge packets from cells of said first column to cells of said second column, to transfer said accumulated charge packets in parallel from the cells of said second column to corresponding cells of a third column, D. means selectively operative following the transfer of said accumulated charge packets from said second column to said third column, to transfer said accumulated charge packets in serial from the cells of said third column, said serially transferred accumulated charge packets corresponding to said output charge packets.

* * * * *